US008690998B2

(12) United States Patent
Ji et al.

(10) Patent No.: US 8,690,998 B2
(45) Date of Patent: Apr. 8, 2014

(54) ELECTRIC PRECIPITATOR

(75) Inventors: Jun Ho Ji, Namyangju-si (KR); In Sang Hwang, Hwaseong-si (KR); Byeong Cheol Yoon, Suwon-si (KR); Jun Young Lee, Daejeon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 114 days.

(21) Appl. No.: 13/313,374

(22) Filed: Dec. 7, 2011

(65) Prior Publication Data

US 2012/0160106 A1 Jun. 28, 2012

(30) Foreign Application Priority Data

Dec. 24, 2010 (KR) ..... 10-2010-0134778

(51) Int. Cl.
*B03C 3/47* (2006.01)

(52) U.S. Cl.
USPC ..... 96/79; 96/86; 96/87; 96/88; 96/96

(58) Field of Classification Search
USPC ..... 96/69, 75–79, 83, 84, 86–88, 96, 98, 96/99; 95/79
See application file for complete search history.

(56) References Cited

U.S. PATENT DOCUMENTS

| | | | | | |
|---|---|---|---|---|---|
| 2,528,842 | A * | 11/1950 | Penney | | 96/86 |
| 2,970,670 | A * | 2/1961 | Nodolf | | 96/79 |
| 3,026,964 | A * | 3/1962 | Penney | | 96/74 |
| 3,518,462 | A * | 6/1970 | Brown | | 310/10 |
| 3,849,090 | A * | 11/1974 | Remick | | 96/86 |
| 4,231,766 | A * | 11/1980 | Spurgin | | 96/79 |
| 5,290,343 | A * | 3/1994 | Morita et al. | | 96/39 |
| 5,302,190 | A * | 4/1994 | Williams | | 95/57 |
| 5,466,279 | A * | 11/1995 | Hattori et al. | | 96/69 |
| 5,766,318 | A * | 6/1998 | Loreth et al. | | 96/69 |
| 5,993,521 | A * | 11/1999 | Loreth et al. | | 96/69 |
| 6,090,189 | A * | 7/2000 | Wikstrom et al. | | 96/69 |
| 6,251,171 | B1 * | 6/2001 | Marra et al. | | 96/69 |
| 7,077,890 | B2 * | 7/2006 | Botvinnik | | 96/69 |
| 2005/0051028 | A1 * | 3/2005 | Botvinnik | | 96/88 |
| 2008/0314250 | A1 * | 12/2008 | Cowie et al. | | 96/86 |

FOREIGN PATENT DOCUMENTS

| | | | | |
|---|---|---|---|---|
| JP | 54-136476 A | * 10/1979 | | 96/79 |
| JP | 11-576 | 1/1999 | | |
| KR | 10-0601394 | 2/2006 | | |

* cited by examiner

*Primary Examiner* — Richard L Chiesa
(74) *Attorney, Agent, or Firm* — Staas & Halsey LLP

(57) ABSTRACT

An electric precipitator includes a charge unit disposed at an upstream part and a dust collection unit disposed at a downstream part, the charge unit includes charge electrodes and a discharge wire disposed between two neighboring charge electrodes and separated from the charge electrodes, the dust collection unit includes high voltage electrodes, front ends of which are opposite to the charge unit, and low voltage electrodes, front ends of which are opposite to the charge unit and which alternate with high voltage electrodes, and the front ends of high voltage electrodes protrude toward the charge unit as compared to the front ends of low voltage electrodes, thereby guiding electrons to the discharge electrodes due to an electric field formed between the front ends of the high voltage electrodes and the discharge electrodes and thus reducing current leakage through the low voltage electrodes.

12 Claims, 11 Drawing Sheets
(8 of 11 Drawing Sheet(s) Filed in Color)

ELECTRIC PRECIPITATOR

CROSS-REFERENCE TO RELATED APPLICATIONS

This application claims the benefit of Korean Patent Application No. 10-2010-0134778, filed on Dec. 24, 2010 in the Korean Intellectual Property Office, the disclosure of which is incorporated herein by reference.

BACKGROUND

1. Field

Embodiments of the present disclosure relate to an electric precipitator which collets foreign substances, such as dust, from air flowing.

2. Description of the Related Art

In general, an electric precipitator is used under the condition that it is mounted on an air conditioner, etc., and is disposed on a channel through which air flows to collect contaminants, such as dust, from air passing through the electric precipitator through electric attraction.

The electric precipitator generally collects contaminants using a two-stage electric dust collection method including a charge unit disposed at an upstream part in an air flow direction to charge the contaminants and a dust collection unit disposed at a downstream part in the air flow direction to collect the charged contaminants through electric attraction.

In such a two-stage type electric precipitator, the charge unit includes a pair of charge electrodes separated from each other to form a cathode and a discharge wire separated from the two charge electrodes and disposed between the two charge electrodes to form an anode, and the dust collection unit includes a plurality of high voltage electrodes and a plurality of low voltage electrodes alternately disposed and separated from each other.

SUMMARY

Therefore, it is an aspect of the present disclosure to provide an electric precipitator which has a more compact configuration.

Additional aspects of the disclosure will be set forth in part in the description which follows and, in part, will be apparent from the description, or may be learned by practice of the disclosure.

In accordance with one aspect of the present disclosure, an electric precipitator includes a charge unit disposed at an upstream part in an air flow direction, and a dust collection unit disposed at a downstream part in the air flow direction, wherein the charge unit includes a plurality of charge electrodes separated from each other, and a discharge wire disposed between two neighboring charge electrodes and separated from the charge electrodes, the dust collection unit includes a plurality of high voltage electrodes, front ends of which are opposite to the charge unit and which are separated from each other, and a plurality of low voltage electrodes, front ends of which are opposite to the charge unit and which alternate with the plurality of high voltage electrodes, and the front ends of the plurality of high voltage electrodes protrude toward the charge unit as compared to the front ends of the plurality of low voltage electrodes.

The front ends of the plurality of low voltage electrodes may be located in a straight line perpendicular to the air flow direction.

The front ends of the plurality of high voltage electrodes may protrude toward the charge unit by 3 mm as compared to the front ends of the plurality of low voltage electrodes.

The front ends of the plurality of high voltage electrodes may be located in a straight line perpendicular to the air flow direction.

An insulating member may be disposed at a high voltage electrode located in a straight line with the discharge wire in the air flow direction from among the plurality of high voltage electrodes.

The insulating member may be formed in a bar type extended in parallel with the discharge wire.

The insulating member may include a groove to accommodate the front end of the high voltage electrode.

The electric precipitator may further include a subsidiary insulating member disposed in front of the discharge wire, wherein the subsidiary insulating member is located in a straight line with the discharge wire in the air flow direction.

An interval between the discharge wire and the charge electrodes may be greater than an interval between the discharge wire and the front ends of the high voltage electrodes.

The electric precipitator may further include a spacer to maintain a state in which the high voltage electrodes and the low voltage electrodes are separated from each other, and the spacer may include a plurality of support parts disposed between the high voltage electrodes and the low voltage electrodes to support the high voltage electrodes and the low voltage electrodes, and connection parts connecting the plurality of support parts.

In accordance with another aspect of the present disclosure, an electric precipitator includes a charge unit disposed at an upstream part in an air flow direction, and a dust collection unit disposed at a downstream part in the air flow direction, wherein the charge unit includes a plurality of charge electrodes separated from each other and a discharge wire disposed between two neighboring charge electrodes and separated from the charge electrodes, the dust collection unit includes a plurality of high voltage electrodes, front ends of which are opposite to the charge unit and which are separated from each other, and a plurality of low voltage electrodes, front ends of which are opposite to the charge unit and which alternate with the plurality of high voltage electrodes, an interval between the discharge wire and a high voltage electrode located in a straight line with the discharge wire in the air flow direction from among the plurality of high voltage electrodes is smaller than an interval between the discharge wire and the charge electrodes, and an insulating member is disposed between the high voltage electrode located in the straight line with the discharge wire and the discharge wire.

In accordance with a further aspect of the present disclosure, an electric precipitator includes a charge unit disposed at an upstream part in an air flow direction and a dust collection unit disposed at a downstream part in the air flow direction, wherein the charge unit includes a plurality of charge electrodes separated from each other and a discharge wire disposed between two neighboring charge electrodes and separated from the charge electrodes, the dust collection unit includes a plurality of high voltage electrodes, front ends of which are opposite to the charge unit and which are separated from each other, and a plurality of low voltage electrodes, front ends of which are opposite to the charge unit and which alternate with the plurality of high voltage electrodes, an interval between the discharge wire and a high voltage electrode located in a straight line with the discharge wire in the air flow direction from among the plurality of high voltage electrodes is smaller than an interval between the discharge wire and the charge electrodes, and the front ends of the plurality of high voltage electrodes protrude toward the charge unit as compared to the front ends of the plurality of low voltage electrodes.

BRIEF DESCRIPTION OF THE DRAWINGS

The patent or application file contains at least one drawing executed in color. Copies of this patent or patent application publication with color drawings will be provided by the Office upon request and payment of the necessary fee. These and/or other aspects of the disclosure will become apparent and more readily appreciated from the following description of the embodiments, taken in conjunction with the accompanying drawings of which.

DETAILED DESCRIPTION

Figure 1:
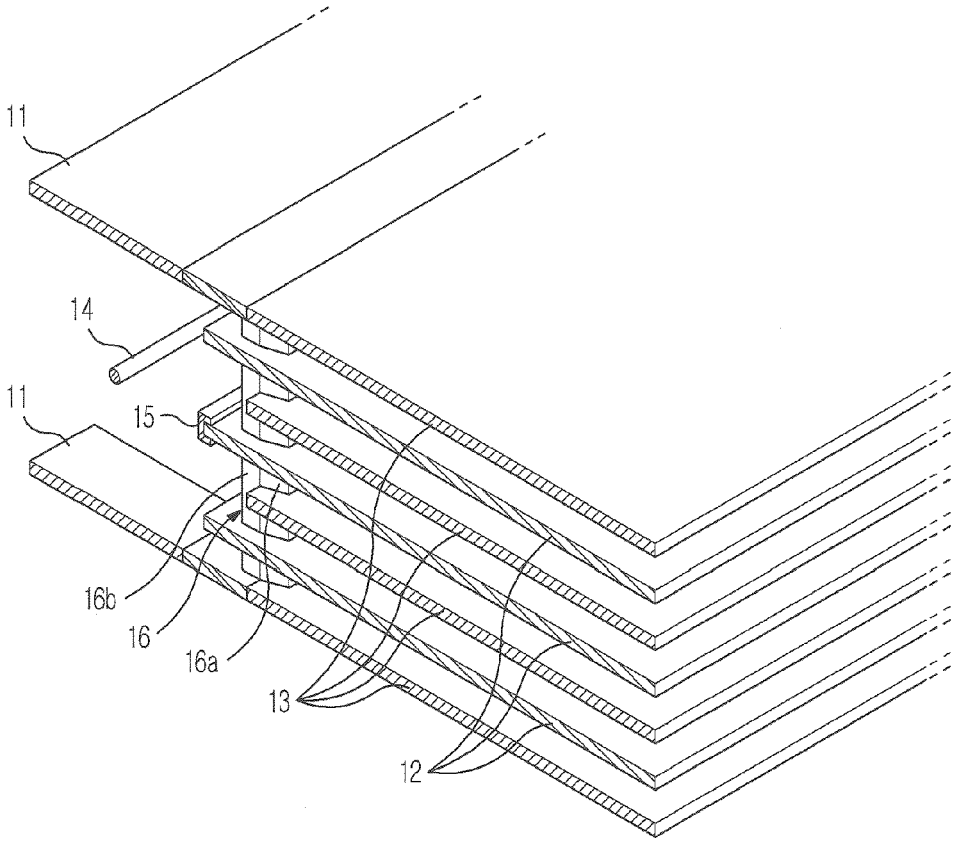
FIG. 1 is a perspective view of an electric precipitator in accordance with one embodiment of the present disclosure.

Reference will now be made in detail to the embodiments of the present disclosure, examples of which are illustrated in the accompanying drawings, wherein like reference numerals refer to like elements throughout.

Hereinafter, an electric precipitator in accordance with one embodiment of the present disclosure will be described in detail with reference to the accompanying drawings.

Figure 2:
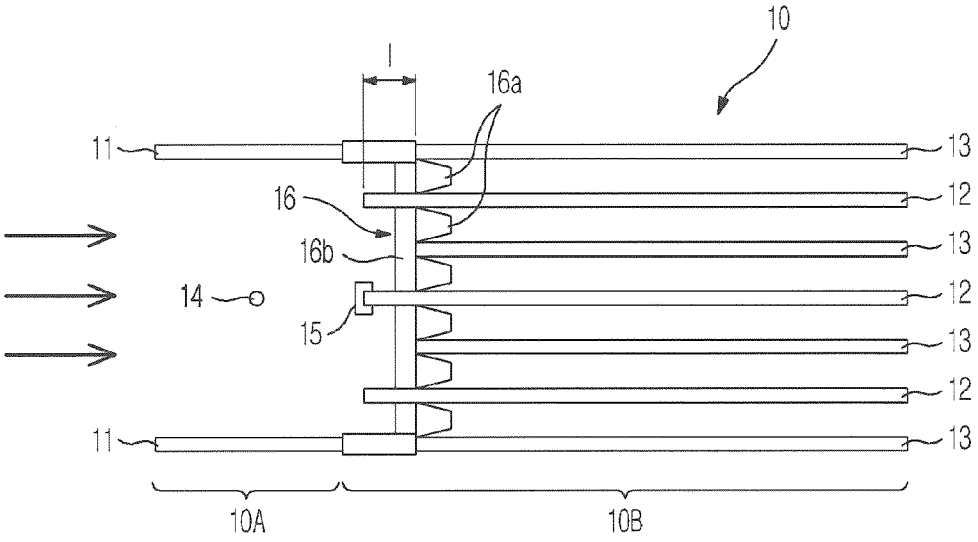
FIG. 2 is a side view of the electric precipitator in accordance with the embodiment of the present disclosure.

As shown in FIGS. 1 and 2, an electric precipitator 10 in accordance with one embodiment of the present disclosure is an apparatus which is disposed on a channel through which air flows to collect contaminants, such as dust, from air passing through the electric precipitator 10, and includes a charge unit 10A disposed at an upstream part in an air flow direction to charge contaminants and a dust collection unit 10B disposed at a downstream part in the air flow direction to electrically collect the contaminants charged by the charge unit 10A.

The charge unit 10A includes a plurality of charge electrodes 11 separated from each other and a discharge wire 14 formed of a wire, separated from the two charge electrodes 11 and disposed between the two charge electrodes 11, and the dust collection unit 10B includes a plurality of dust collection electrodes 12 and 13 separated from each other. In this embodiment, an interval between the charge electrodes 11 is set to 20 mm and an interval between the dust collection electrodes 12 and 13 is set to 2 mm.

The dust collection electrodes 12 and 13 include high voltage electrodes 12, front ends of which are opposite to the charge unit 10A, and to which high voltage is applied, and low voltage electrodes 13, front ends of which are opposite to the charge unit 10A, and to which lower voltage than the high voltage applied to the high voltage electrodes 12 is applied to be operated as ground electrodes. The high voltage electrodes 12 and the low voltage electrodes 13 are alternately disposed and separated from each other. Since the charge unit 10A is disposed at the upstream part in the air flow direction and the dust collection unit 10B is disposed at the downstream part in the air flow direction, as described above, the charge electrodes 11 and the discharge wires 14 are disposed at the upstream part in the air flow direction and the high voltage electrodes 12 and the low voltage electrodes 13 are disposed at the downstream part in the air flow direction.

The electric precipitator 10 further includes a spacer 16 to maintain a state in which the high voltage electrodes 12 and the low voltage electrodes 13 are separated from each other by regular intervals. The spacer 16 includes a plurality of support parts 16*a* disposed between the high voltage electrodes 12 and the low voltage electrodes 13 and supporting the high voltage electrodes 12 and the low voltage electrodes 13 to maintain the state in which the high voltage electrodes 12 and the low voltage electrodes 13 are separated from each other by regular intervals, and connection parts 16*b* connecting the support parts 16*a*.

In order to allow the electric precipitator 10 to have a compact configuration while maintaining a dust collecting capacity of the electric precipitator 10, the charge unit 10A preferably has a thin width.

However, if the width of the charge unit 10A is reduced, an interval between the discharge wire 14 and the dust collection electrodes 12 and 13 becomes narrower than an interval between the discharge wire 14 and the charge electrodes 11, and thus a part of current is leaked through the low voltage electrodes 13 to which relatively low voltage is applied from the discharge wire 14, from among the dust collection electrodes 12 and 13, thereby generating loss. That is, dust collection efficiency of the electric precipitator 10 is lowered.

Figure 3:
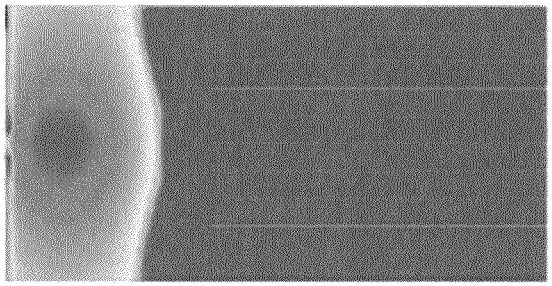
FIGS. 3 to 5 are views illustrating results of simulations representing density distributions of charges according to widths of a charge unit of the electric precipitator.
Figure 4:
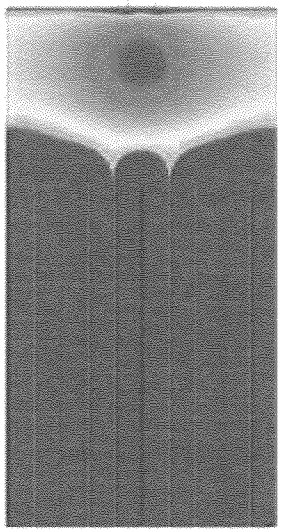
Figure 5:
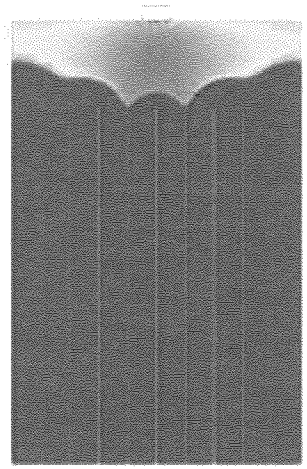

FIGS. 3 to 5 are views illustrating results of simulations in which a current flow is observed while gradually decreasing the width of the charge unit 10A. FIG. 3 illustrates a result of a simulation when the width of the charge unit 10A is 14 mm, and it is confirmed that leakage of current does not occur in this state. FIG. 4 illustrates a result of a simulation when the width of the charge unit 10A is 12 mm, and it is confirmed that 2.7% of current is leaked through the low voltage electrodes 13 of the dust collection unit 10B in this state. Further, FIG. 5 illustrates a result of a simulation when the width of the charge unit 10A is 6 mm, and it is confirmed that 38.5% of current is leaked through the low voltage electrodes 13 of the dust collection unit 10B in this state.

Therefore, in order to prevent leakage of current through the low voltage electrodes 13 while enabling the interval between the discharge wire 14 and the dust collection electrodes 12 and 13 to be narrower than the interval between the discharge wire 14 and the charge electrodes 11, the front ends of the high voltage electrodes 12 located close to the discharge wire 14 protrude toward the charge unit 10A, as compared to the front ends of the low voltage electrodes 13. That is, the front ends of the high voltage electrodes 12 are located at the upstream part in the air flow direction, as compared to the front ends of the low voltage electrodes 13.

Here, the front ends of the low voltage electrodes 13 are disposed in a straight line perpendicular to the air flow direction, and the front ends of the high voltage electrodes 12 are disposed in a straight line perpendicular to the air flow direction. Further, rear ends of the low voltage electrodes 13 and rear ends of the high voltage electrodes 12 are disposed in a straight line perpendicular to the air flow direction.

If the front ends of the high voltage electrodes 12 protrude toward the charge unit 10A, as compared to the front ends of the low voltage electrodes 13, as described above, an electric field is formed between the front ends of the high voltage electrodes 12 and the charge electrodes 11, and such an electric field serves to guide electrons generated from the discharge wire 14 to the charge electrodes 11. Therefore, electrons transmitted to the front ends of the low voltage electrodes 13 distantly separated from the charge unit 10A, as compared to the front ends of the high voltage electrodes 12, is reduced, and thus leakage of current through the low voltage electrodes 12 is reduced.

Further, even if the front ends of the high voltage electrodes 12 and the front ends of the low voltage electrodes 13 are disposed in the above-described manner, it is confirmed that current is intermittently leaked through the low voltage electrodes 13 in real situations. Therefore, in order to more firmly prevent current leakage, an insulating member 15 is installed at the front end of a high voltage electrode 12 which is located in a straight line with the discharge wire 14 in the air flow direction from among the high voltage electrodes 12. The insulating member 15 is formed in a bar shape in parallel with the discharge wire 14, and is provided with a concave groove formed at one side of the insulating member 15 to accommodate the front end of the high voltage electrode 12.

If the insulating member 15 is installed in the above-described manner, the insulating member 15 serves to prevent formation of an electric field between the discharge wire 14 and the low voltage electrodes 13, and thus the electrons transmitted to the low voltage electrodes 13 are more reduced.

Figure 6:
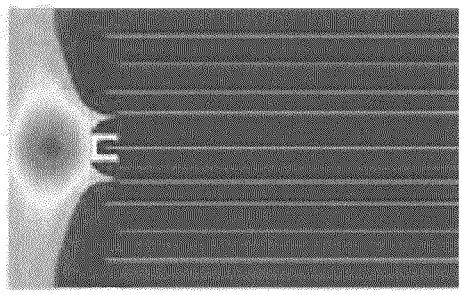
FIGS. 6 to 8 are views illustrating results of simulations representing density distributions of charges according to protruding lengths of high voltage electrodes protruding toward the charge unit of the electric precipitator, as compared to low voltage electrodes.
Figure 7:
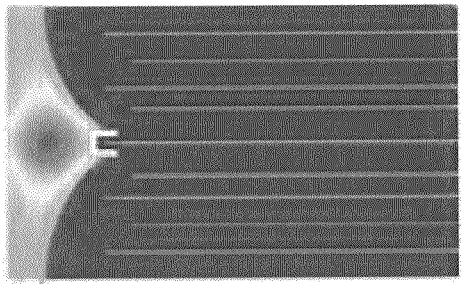
Figure 8:
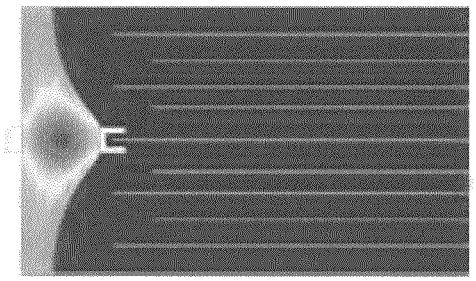

In the above-described electric precipitator 10, the electrons transmitted to the low voltage electrodes 13 are reduced as a protruding length l of the front ends of the high voltage electrodes 12 protruding toward the charge unit 10A, as compared to the low voltage electrodes 13, increases. FIGS. 6 to 8 are views illustrating results of simulations executed while adjusting positions of the front ends of the high voltage electrodes 12 and the front ends of the low voltage electrodes 13.

FIG. 6 illustrates a result of a simulation when the protruding length l of the high voltage electrodes 12 is 1 mm, FIG. 7 illustrates a result of a simulation when the protruding length l of the high voltage electrodes 12 is 2 mm, and FIG. 8 illustrates a result of a simulation when the protruding length l of the high voltage electrodes 12 is 3 mm.

If the protruding length l of the high voltage electrodes 12 is 2 mm, as shown in FIG. 7, the result of simulation represents that current leakage through the low voltage electrodes 13 does not occur. However, in real experimentation, current is intermittently leaked through the low voltage electrodes 13. This is caused by structural instability of the high voltage electrodes 12 and the low voltage electrodes 13 formed in a film type.

Therefore, in the electric precipitator 10 in accordance with this embodiment, in order to prevent the above-described intermittent current leakage, the protruding length l of the high voltage electrodes 12 is set to 3 mm as shown in FIG. 8.

Figure 9:
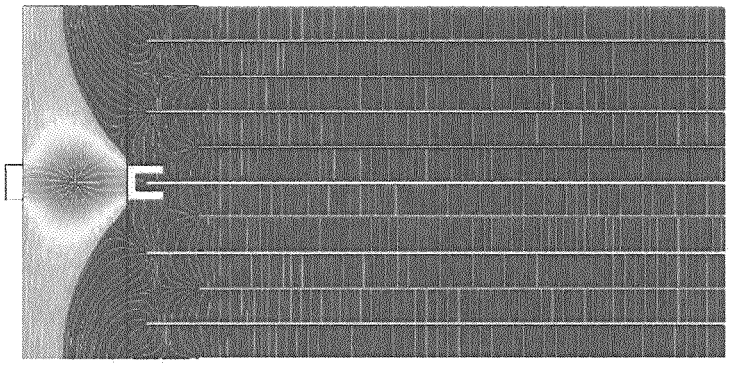
FIG. 9 is a view illustrating results of simulations representing electric force lines due to electric force and density distributions of charges when the electric precipitator in accordance with the embodiment of the present disclosure is operated.
Figure 10:
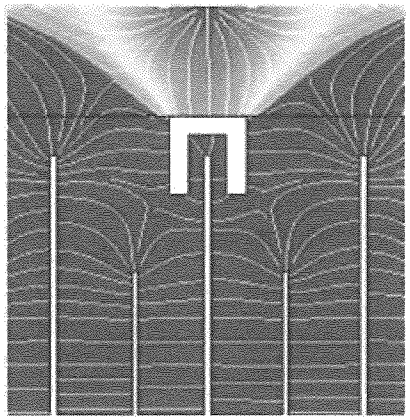
FIG. 10 is a view illustrating results of simulations in an enlarged portion adjacent to an insulating member of FIG. 9.
Figure 11:
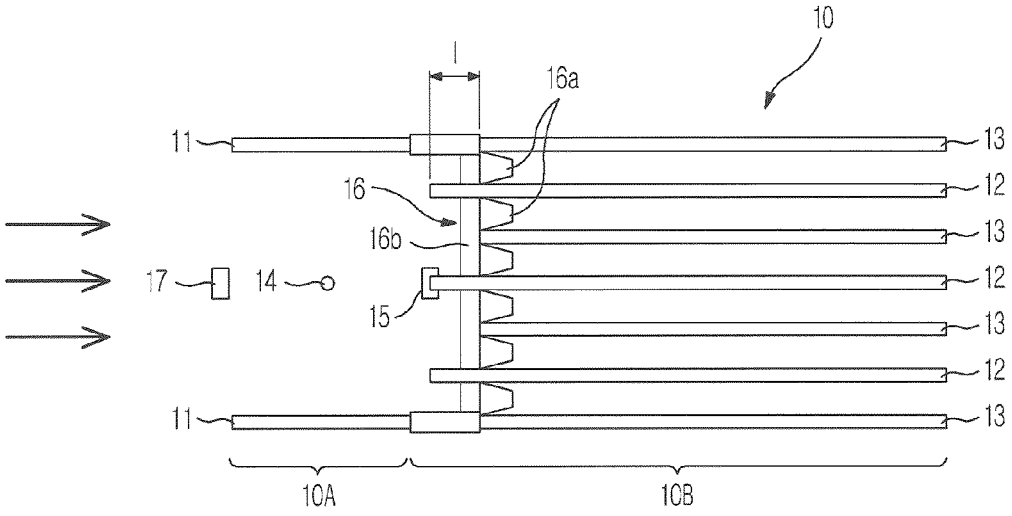
FIG. 11 is a side view of an electric precipitator in accordance with another embodiment of the present disclosure.

FIG. 9 illustrates electric force lines due to an electric field and density distributions of charges when the above-described electric precipitator 10 is operated, and FIG. 10 illustrates electric force lines and density distributions of charges around the insulating member 15. In FIGS. 9 and 10, white lines represent electric force lines due to an electric field, and electrons move along the electric force lines. As shown in FIGS. 9 and 10, electrons radiated from the discharge wire 14 move to the charge electrodes 11 due to electric force formed between the front ends of the high voltage electrodes 12 and the charge electrodes 11. Further, as shown in FIG. 11, the insulating member 15 serves to prevent application of electric force due to an electric field between the discharge wire 14 and the low voltage electrodes 13. Therefore, through the above-described two structures, all electrons radiated from the discharge wire 14 are transmitted to the discharge electrodes 11, and are scarcely transmitted to the low voltage electrodes 13.

In the above-described electric precipitator 10, it is confirmed that current leakage through the low voltage electrodes 13 is completely removed as the result of simulations, and current leakage is reduced to 5% or less in real experimentation.

Further, in accordance with another embodiment of the present disclosure, as shown in FIG. 11, a subsidiary insulating member 17 may be additionally disposed at the upstream part in the air flow direction of the discharge wire 14 to prevent electrons radiated from the discharge wire 14 from being transmitted to a conductive object even if the conductive object is disposed at the upstream part of the electric precipitator 10, thus preventing current leakage. Here, the subsidiary insulating member 17 is located in a straight line with the discharge wire 14 in the air flow direction.

Although the electric precipitator 10 in accordance with this embodiment has a structure in which the front ends of the high voltage electrodes 12 protrude toward the charge unit 10A as compared to the front ends of the low voltage electrodes 13 and a structure in which the insulating member 15 is disposed between a high voltage electrode 12 being located in a straight line with the discharge wire 14 from among the high voltage electrodes 12 and the discharge wire 14, the electric precipitator 10 is not limited to these structures. Even if any one structure of the two structures is employed, current leakage may be prevented while reducing the width of the charge unit 10A.

As is apparent from the above description, in an electric precipitator in accordance with one embodiment of the present disclosure, front ends of high voltage electrodes protrude toward a charge unit as compared to front ends of low voltage electrodes, an electric field is formed between the front ends of the high voltage electrodes and charge electrodes, and such an electric field guides electrons radiated from a discharge wire to the charge electrodes, thereby reducing current leakage generated by transmission of the electrons radiated from the discharge wire to the low voltage electrodes.

Further, an insulating member disposed between the discharge wire and a high voltage electrode located in a straight line with the discharge wire in an air flow direction from among the high voltage electrodes prevents the electrons radiated from the discharge wire from moving to the low voltage electrodes, thereby reducing current leakage.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. An electric precipitator comprising:

a charge unit disposed at an upstream part in an air flow direction; and a dust collection unit disposed at a downstream part in the air flow direction, wherein the charge unit includes a plurality of charge electrodes separated from each other, and a discharge wire disposed between two neighboring charge electrodes and separated from the charge electrodes;

the dust collection unit includes a plurality of high voltage electrodes, front ends of which are opposite to the charge unit and which are separated from each other, and a plurality of low voltage electrodes, front ends of which are opposite to the charge unit and which alternate with the plurality of high voltage electrodes; and the front ends of the plurality of high voltage electrodes protrude toward the charge unit as compared to the front ends of the plurality of low voltage electrodes; and an insulating member is disposed at a high voltage electrode located in a straight line with the discharge wire in the air flow direction from among the plurality of high voltage electrodes.

2. The electric precipitator according to claim 1, wherein the front ends of the plurality of low voltage electrodes are located in a straight line perpendicular to the air flow direction.

3. The electric precipitator according to claim 2, wherein the front ends of the plurality of high voltage electrodes protrude toward the charge unit by 3 mm as compared to the front ends of the plurality of low voltage electrodes.

4. The electric precipitator according to claim 2, wherein the front ends of the plurality of high voltage electrodes are located in a straight line perpendicular to the air flow direction.

5. The electric precipitator according to claim 1, wherein the insulating member is formed in a bar shape extended in parallel with the discharge wire.

6. The electric precipitator according to claim 1, wherein the insulating member includes a groove to accommodate the front end of the high voltage electrode.

7. The electric precipitator according to claim 1, further comprising a subsidiary insulating member disposed in front of the discharge wire, wherein the subsidiary insulating member is located in a straight line with the discharge wire in the air flow direction.

8. The electric precipitator according to claim 1, wherein an interval between the discharge wire and the charge electrodes is greater than an interval between the discharge wire and the front ends of the high voltage electrodes.

9. The electric precipitator according to claim 1, further comprising a spacer to maintain a state in which the high voltage electrodes and the low voltage electrodes are separated from each other, wherein the spacer includes a plurality of support parts disposed between the high voltage electrodes and the low voltage electrodes to support the high voltage electrodes and the low voltage electrodes, and connection parts connecting the plurality of support parts.

10. An electric precipitator comprising:

a charge unit disposed at an upstream part in an air flow direction; and a dust collection unit disposed at a downstream part in the air flow direction, wherein the charge unit includes a plurality of charge electrodes separated from each other, and a discharge wire disposed between two neighboring charge electrodes and separated from the charge electrodes;

the dust collection unit includes a plurality of high voltage electrodes, front ends of which are opposite to the charge unit and which are separated from each other, and a plurality of low voltage electrodes, front ends of which are opposite to the charge unit and which alternate with the plurality of high voltage electrodes;

an interval between the discharge wire and a high voltage electrode located in a straight line with the discharge wire in the air flow direction from among the plurality of high voltage electrodes is smaller than an interval between the discharge wire and the charge electrodes; and an insulating member is disposed between the high voltage electrode located in the straight line with the discharge wire in the air flow direction and the discharge wire.

11. The electric precipitator according to claim 10, wherein the front ends of the plurality of high voltage electrodes protrude toward the charge unit as compared to the front ends of the plurality of low voltage electrodes.

12. An electric precipitator comprising:

a charge unit disposed at an upstream part in an air flow direction; and a dust collection unit disposed at a downstream part in the air flow direction, wherein the charge unit includes a plurality of charge electrodes separated from each other, and a discharge wire disposed between two neighboring charge electrodes and separated from the charge electrodes;

the dust collection unit includes a plurality of high voltage electrodes, front ends of which are opposite to the charge unit and which are separated from each other, and a plurality of low voltage electrodes, front ends of which are opposite to the charge unit and which alternate with the plurality of high voltage electrodes;

an interval between the discharge wire and a high voltage electrode located in a straight line with the discharge wire in the air flow direction from among the plurality of high voltage electrodes is smaller than an interval between the discharge wire and the charge electrodes; and the front ends of the plurality of high voltage electrodes protrude toward the charge unit as compared to the front ends of the plurality of low voltage electrodes; and an insulating member is disposed between the high voltage electrode located in the straight line with the discharge wire in the air flow direction and the discharge wire.

* * * * *

UNITED STATES PATENT AND TRADEMARK OFFICE

CERTIFICATE OF CORRECTION

PATENT NO. : 8,690,998 B2
APPLICATION NO. : 13/313374
DATED : April 8, 2014
INVENTOR(S) : Ji et al.

It is certified that error appears in the above-identified patent and that said Letters Patent is hereby corrected as shown below:

In the Claims

Column 7, Line 8, in Claim 1, after “electrodes;” delete “and”.
Column 8, Lines 17-18, in Claim 10, after “electrodes;” delete “and”.
Column 8, Lines 45-46, in Claim 12, after “electrodes;” delete “and”.

Signed and Sealed this
Twelfth Day of August, 2014

Michelle K. Lee

Michelle K. Lee
*Deputy Director of the United States Patent and Trademark Office*